US009505259B2

(12) United States Patent
Provda et al.

(10) Patent No.: US 9,505,259 B2
(45) Date of Patent: Nov. 29, 2016

(54) GRIP FOR HAND-HELD TOOLS AND METHOD OF USING THE SAME

(71) Applicants: Asher B. Provda, Brightwaters, NY (US); Alexander S. Provda, Woodland Hills, CA (US)

(72) Inventors: Asher B. Provda, Brightwaters, NY (US); Alexander S. Provda, Woodland Hills, CA (US)

( * ) Notice: Subject to any disclaimer, the term of this patent is extended or adjusted under 35 U.S.C. 154(b) by 146 days.

(21) Appl. No.: 14/300,968

(22) Filed: Jun. 10, 2014

(65) Prior Publication Data

US 2015/0352891 A1 Dec. 10, 2015

(51) Int. Cl.
*B43K 23/008* (2006.01)
*B43K 23/004* (2006.01)
*B44D 3/00* (2006.01)

(52) U.S. Cl.
CPC ..... *B43K 23/008* (2013.01); *B43K 23/004* (2013.01); *B44D 3/00* (2013.01)

(58) Field of Classification Search
CPC combination set(s) only.
See application file for complete search history.

(56) References Cited

U.S. PATENT DOCUMENTS

| | | | | |
|---|---|---|---|---|
| 564,178 | A * | 7/1896 | France | B43K 23/004 15/443 |
| 1,807,415 | A * | 5/1931 | La France | B43K 23/004 401/6 |
| 4,526,547 | A * | 7/1985 | Rusk | G09B 11/00 401/6 |
| 5,143,463 | A * | 9/1992 | Pozil | G09B 11/02 15/443 |
| 6,908,245 | B1 * | 6/2005 | Schulken | B43K 23/004 15/443 |
| 7,794,163 | B2 | 9/2010 | Bush, III | |

* cited by examiner

*Primary Examiner* — David Walczak
(74) *Attorney, Agent, or Firm* — Feldman Law Group, P.C.; Stephen E. Feldman

(57) ABSTRACT

A grip used with a hand-held tool that includes a top, a bottom, a right side, a left side, a rear side, a right finger guide and a left finger guide. The right finger guide can be formed on the right side of the grip and the left finger guide can be formed on the left side of the grip so that the right finger guide and the left finger guide are adjacent to one another thereby forming a pinch grasp area.

7 Claims, 8 Drawing Sheets

GRIP FOR HAND-HELD TOOLS AND METHOD OF USING THE SAME

BACKGROUND

The disclosed technology relates to a grip for hand-held tools. More particularly, to a grip for hand-held tools that promotes thumb opposition, e.g., a pinch grasp.

Thumb opposition refers to the ability to turn and rotate the thumb so that it can touch each fingertip of the same hand. Children begin to develop thumb rotation to form a spherical grip between their first and second year of life. The thumb begins to develop a better ability to rotate and oppose the other fingers. For a variety of reasons, many children lack the thumb stability for sustaining the thumb in a partially bent position when using writing and drawing tools. Often, they have difficulty holding implements between the tip of the thumb and opposing fingertips, e.g., a tip of an index finger. Children, sometimes, substitute thumb opposition by pulling the thumb straight up beside the index finger or wrapped over other fingers when writing and drawing. This substitution requires the use of stronger hand muscles which in turn causes hand fatigue and difficulty controlling the amount of pressure needed for writing with a pencil or crayon. Penmanship is less precise and work product may be messy.

Additionally, as people age due to medical factors, muscle deterioration and other aging processes, it becomes difficult for older people to grasp handheld tools. In some cases, older people can only use the tool for short periods of time before fatigue sets in. This also hold true with people with certain disabilities.

SUMMARY

The disclosed technology takes advantage of the rotating thumb and provides a grip that promotes thumb opposition for hand tools that have elongated handles, e.g., writing instruments, paint brushes, utility knives, etc.

In some implementations, the grip of the disclosed technology aids in gripping writing style performance by using an easy pinch maneuver of the thumb and index finger together. The grip has finger guides that allow for this maneuver. That is, ledges and depressions on the grip easily guide the thumb and index finger in a pinch grasp which allows those with difficulty holding a writing instrument a guide for proper, pinch-grasp writing placement. In other implementations, the grip of the disclosed technology aids in the holding of hand-held tools having elongated handles, e.g. paint brushes, utility knives and any other tool in which a pinch grasp can be utilized to hold the tool in a working position. The grip of the disclosed technology can be a grip that slides onto a hand-held tool or can be incorporated into the handle itself.

In one implementation, a grip for a hand-held tool comprises: a top, a bottom, a right side, a left side, a rear side, a right finger guide and a left finger guide, the right finger guide being formed on the right side and the left finger guide being formed on the left side, the right finger guide and the left finger guide being adjacent to one another so as to form a pinch grasp area.

In some implementations, the pinch grasp area can accommodate a distal end of an index finger and a distal end of a thumb of a user so that a tip of the thumb is opposed to a tip of the index finger in a pinch grasp. In some implementations, the grip can further comprise: a through hole that extends from the top to the bottom of the grip.

In some implementations, the right finger guide can be partially formed from (1) a first ledge extending from a right bottom edge of the grip between a front vertical edge and a right vertical edge, the first ledge having a rounded shape and a first depression, the first depression having a first depth wherein the first depth of the first depression in combination with the rounded shape of the first ledge forms a first pocket for receiving a tip of a thumb. And the left finger guide can be partially formed from a second ledge extending from a left bottom edge of the grip between a front vertical edge and a left vertical edge, the second ledge having a rounded shape and a second depression, the second depression having a second depth wherein the second depth of the second depression in combination with the rounded shape of the second ledge forms a second pocket for receiving a tip of an index finger.

In some implementations, a rear side can include a third depression for receiving a middle finger. In some implementations, the grip can be constructed of a soft and pliable material and can be substantially triangular.

In another implementation, a grip for a hand-held tool comprises: a top, a bottom, a right side, a left side, a rear side, a right finger guide and a left finger guide, the right finger guide being formed on the right side, the right finger guide is partially formed from a first ledge extending from a right bottom edge of the grip between a front vertical edge and a right vertical edge, the first ledge having a rounded shape, the right finger guide is partially formed from a first depression, the first depression having a first depth, wherein the first depth of the first depression in combination with the rounded shape of the first ledge forms a first pocket for receiving a tip of a thumb, the left finger guide being formed on the left side, the left finger guide is partially formed from a second ledge extending from a left bottom edge of the grip between a front vertical edge and a left vertical edge, the second ledge having a rounded shape, the left finger guide is partially formed from a second depression, the second depression having a second depth, wherein the second depth of the second depression in combination with the rounded shape of the second ledge forms a second pocket for receiving a tip of an index finger, and the right finger guide and the left finger guide being adjacent to one another so as to form a pinch grasp area.

In another implementation, a grip for a hand-held tool comprises: a top, a bottom, a right side, a left side, a rear side, a right finger guide and a left finger guide, the right finger guide being formed on the right side, the right finger guide is partially formed from a first ledge having a rounded shape and a first depression having a first depth, wherein the first depth of the first depression in combination with the rounded shape of the first ledge forms a first pocket for receiving a tip of a thumb, the left finger guide being formed on the left side, the left finger guide is partially formed from a second ledge having a rounded shape and a second depression having a second depth, wherein the second depth of the second depression in combination with the rounded shape of the second ledge forms a second pocket for receiving a tip of an index finger, and the first pocket and second pocket being adjacent to one another so as to form a pinch grasp area.

The grip of the disclosed technology does not allow a tip of a user's index finger encounter a tip of a user's thumb during use. The grip also conforms to a user's fingers making the grip feel as if it part of the user's hand. Further, the grip achieved by the disclosed technology is comfortable and natural. A user will easy adapt to the shape of the grip and their handwriting grip will change automatically or the use of a hand-held tool will become less taxing.

DETAILED DESCRIPTION

This specification describes technologies relating to a grip for hand-held tools.

During infancy of a human child, a pincer grasp is a developmental milestone that typically occurs at 9 to 12 months of age. By opposing the thumb with respect to the index finger, the child is able to pick up and place items in a controlled manner. Over time, the child develops using this pincer grasp for other important tasks, such as, holding pencils, crayons and markers or using certain hand-held tools.

An important aspect of a pinch grasp is that it is able to form a circle having a web space opposite the tips of the thumb and index finger. The web space forms because of the extra skin at the base of the thumb and index finger and it has an appearance of a web, similar to animals that have webbed toes. An open web space is important for holding writing and drawing tools, as well as certain hand tools, correctly. When the space is open and the tool is held with the thumb tip and index finger tip, greater precision and control is achieved, e.g., written work and drawings may become more accurate. Additionally, there is less stress on the joints of the hand and, thus, less fatigue.

The grip of the disclosed technology takes advantage of the pinch grasp writing style. That is, the pinch grip of the disclosed technology promotes a pinch grasp using the index finger and thumb by creating a natural feeling grip that easily positions a user's fingers in a pinch grasp. The pinch grip of the disclosed technology serves many useful purposes, e.g., teaching a child a proper holding grip for a writing instrument, improving a person's writing style, decreasing a person's cramping when writing for long periods of time, aiding the elderly and the disabled in holding hand-held tools, ect.

Figure 1:
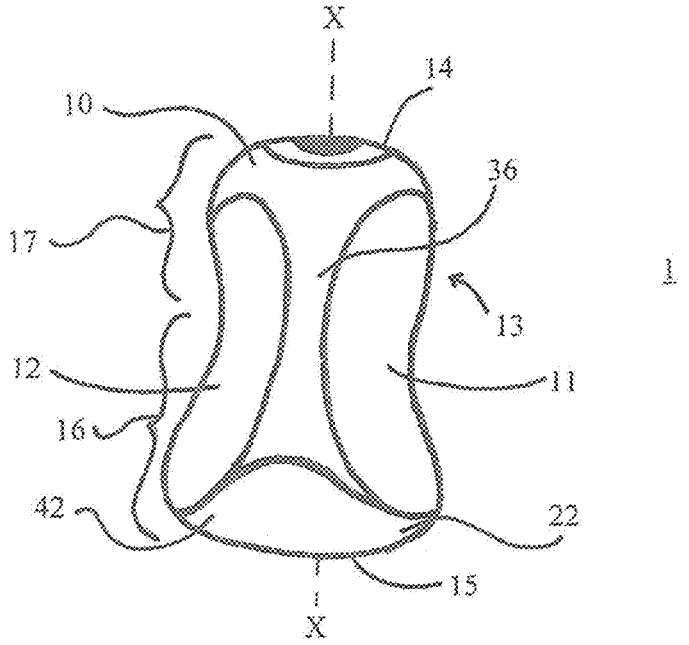
FIG. 1 shows a front view of a grip of the disclosed technology.

In FIG. 1, a grip of the disclosed technology is shown. The pinch grip 1 is an ergonomic-ally-shaped griping aid that promotes a pinch grasp using the index finger and thumb. The pinch grip 1 can be made from a soft and pliable material, e.g., silicone, custom TPE (thermo-plastic elastomer), and harder plastics depending on the user and the tool in which the grip is attached or incorporated into.

The grip 1 includes a main body 10 having a longitudinal axis located along a centerline (X) of the body 10. The body 10 includes three sides 11, 12, 13 forming a substantially three dimensional triangular shape, a top 14 and a bottom 15. The lower portion 16 of the grip 1 can be substantially triangular and as the grip 1 extends from the bottom 15 to the top 14, the grip 1 can become less triangular and more spherical. Even though the upper portion 17 of the grip 1 is somewhat spherical, the grip 1 for purposes of this disclosure will be referred to as having three sides 11, 12, 13 which match up with the three sides 11, 12, 13 of the lower portion 16. In some implementations, the upper portion 17 of the body 10 can be larger than a lower portion 16 of the body 10.

As shown in FIGS. 1-6, the grip has nine edges 30-38. Three edges 30-32 connect the bottom 15 to the three sides 11-13 (right bottom edge 30, left bottom edge 31 and rear bottom edge 32), three edges 33-35 connect the top 14 to the sides 11-13 (right top edge 33, left top edge 34 and rear top edge 35) and three edges 36-38 connect the three sides 11-13 to one another (front vertical edge 36, right vertical edge 37 and left vertical edge 38).

Figure 2:
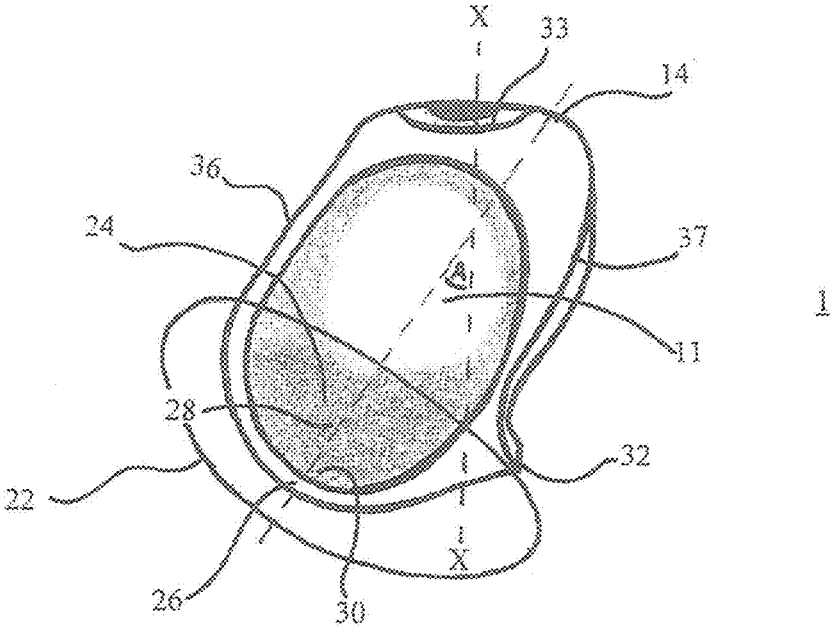
FIG. 2 shows a right side view of a grip of the disclosed technology.

As shown in FIG. 2, a first side 11 contains finder guide 22. Finger guide 22 can include depression 24 and ledge 26. The depression 24 can be elongated and concave to allow for placement of a part of a user's thumb. The depression 24 has an axis of approximately 10-35 degrees off the longitudinal axis, the concave portion can have a varying depth with a maximum depth of 0.5-5 mm and the depression length can be 1-5 cm. The length of the depression extends from a corner where the right top edge 33, rear top edge 35 and the right vertical edge 37 intersect to a corner where the front vertical edge 36, the right bottom edge 30 and the left bottom edge 31 intersect. These sizes may be made smaller or larger depending on the age of the intended user. the right bottom edge 30 of the grip and continues to a right vertical edge 37. The ledge The ledge 26 extends from a front vertical edge 36 and protrudes out from 26 has a maximum width of about 2-20 mm with its maximum width at a midpoint between the front vertical edge 36 and the right vertical edge 37. The ledge 26 also can also have rounded shape that curves upwards to mirror the shape of a tip of a human thumb. The ledge 26 is used to retain a thumb tip within the finger guide 22.

Figure 7:
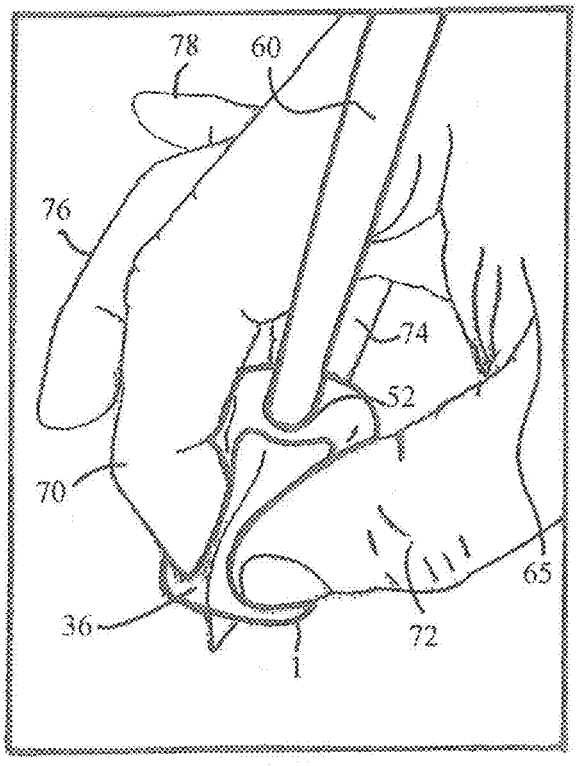
FIGS. 7-9 show perspective views of grips mounted on a writing instrument and being held by a user according to the disclosed technology.
Figure 8:
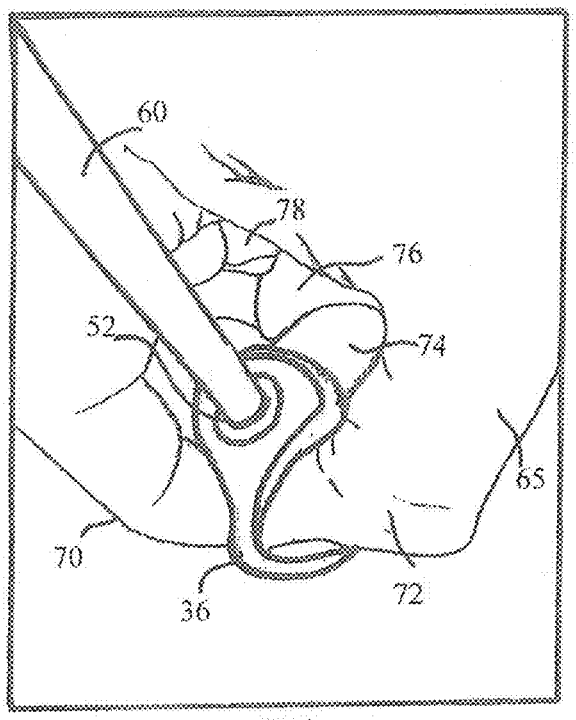
Figure 9:
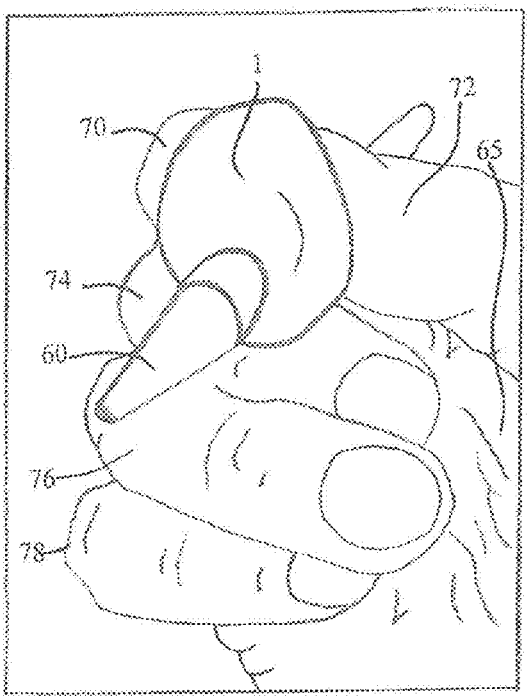

The finger guide 22 promotes a pinch grasp. That is, the depth of the depression 24 in combination with the rounded shape of the ledge 26 forms a pocket 28 for receiving thumb. In other words, the pocket 28 is a cast in the image of a thumb tip. And when a thumb is placed within this pocket 28, the pocket can conform to the shape of the thumb. Specifically, the inner part of the thumb can conform to the depression 24 and the ledge 26 can conform to the outer or nail side of the thumb, as shown in FIGS. 7-9.

Figure 3:
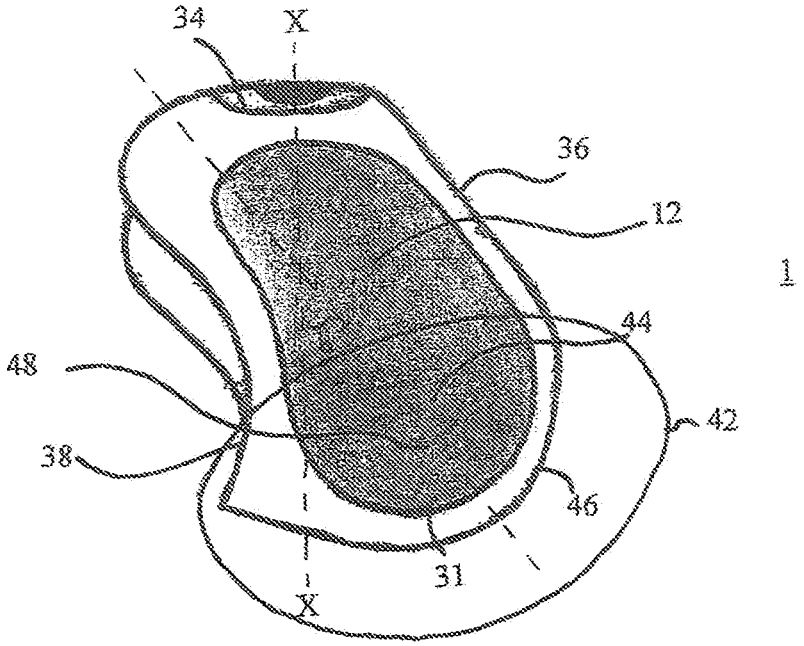
FIG. 3 shows a left side view of a grip of the disclosed technology.

As shown in FIG. 3, a second side 12 contains finger guide 42. Finger guide 42 can include depression 44 and ledge 46. The depression 44 has an axis of approximately 10-35 degrees off the longitudinal axis, the concave portion can have a varying depth with a maximum depth of 0.5-5 mm and the depression length can be 1-5 cm. The length of the depression extends from a corner where the left top edge 34, rear top edge 35 and the left vertical edge 38 intersect to a corner where the front vertical edge 36, the left bottom edge 31 and the right bottom edge 30 intersect. These sizes may be made smaller or larger depending on the age of the intended user.

The ledge 46 extends from a front vertical edge 36 and protrudes out from the left bottom edge 31 and continues to the left vertical edge 38. The ledge 46 has a maximum width of about 2 and 20 mm with its maximum width at a midpoint between the front vertical edge 36 and the left vertical edge 38. The ledge 46 also can also have rounded shape that curves upwards to mirror the shape of a tip of a human index finger. The ledge 46 is used to retain an index finger tip within the linger guide 42.

The finger guide 42 promotes a pinch grasp. That is, the depth of the depression 44 in combination with the rounded shape of the ledge 46 forms a pocket 48 for receiving an index finger. In other words, the pocket 48 is a cast in the image of a index finger tip. And when the index finger is placed within this pocket 48, the pocket 48 can conform to the shape of the user's index finger. Specifically, the inner part of the index finger can conform to the depression and the ledge can conform to the outer or nail side of the index finger.

The right finger guide and the left finger guide are adjacent to one another so as to form a pinch grasp area. In other words, together pocket 28 and pocket 48 form a pinch grasp area capable of accommodating a distal end of an index finger and a distal end of a thumb of a user so that a tip of the thumb can be opposed to a tip of the index finger in a pinch grasp. Additionally, the front vertical edge 36 can be raised so that the edge 36 can provide a common wail for separating the index finger 70 and the thumb 72 when in use thereby preventing the fingers 70, 72 from overlapping each other.

Figure 4:
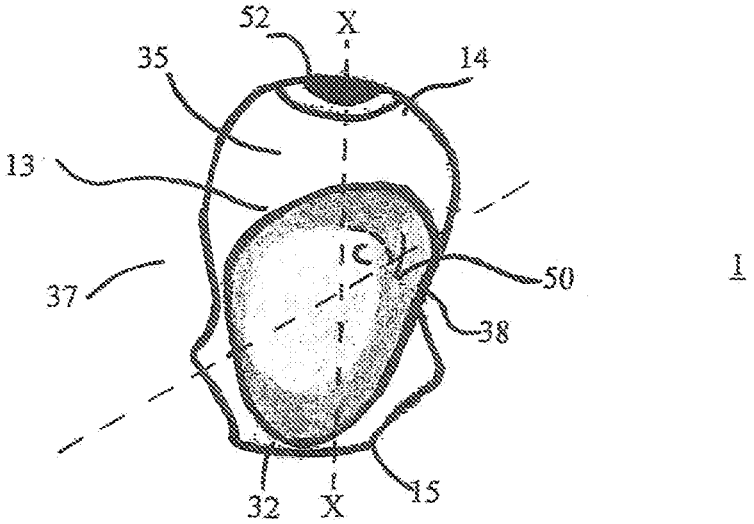
FIG. 4 shows a rear view of a grip of the disclosed technology.
Figure 5:
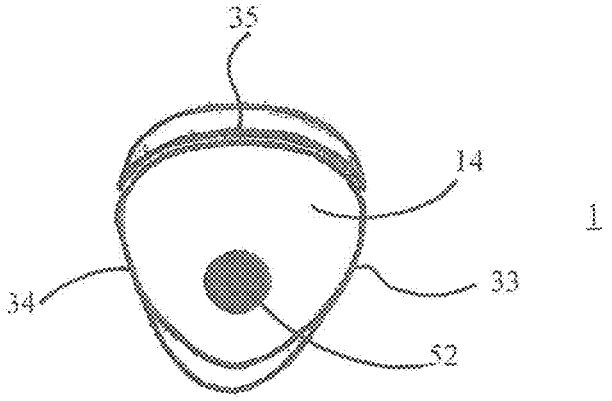
FIG. 5 shows a top view of a grip of the disclosed technology.
Figure 6:
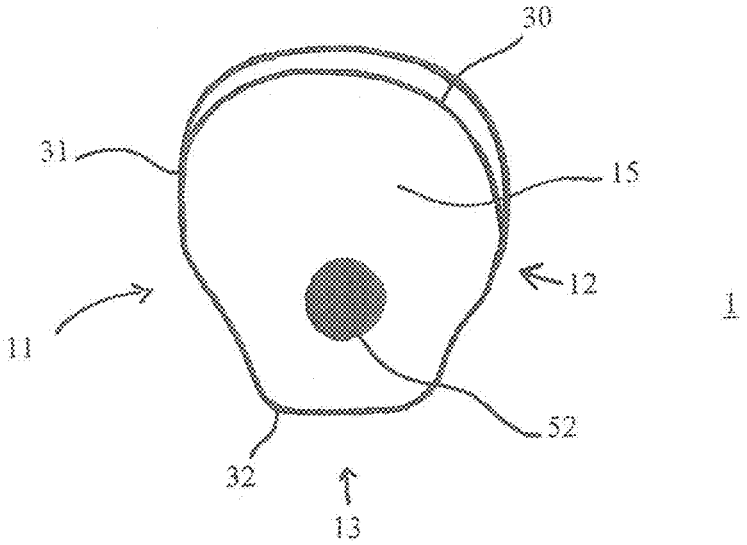
FIG. 6 shows a bottom view of a grip of the disclosed technology.

As shown in FIG. 4, a third depression 50 can be formed on the third side 13 of the grip 1. This depression 50 receives a part of a user's middle finger, as shown in FIG. 7. The depression 50 has an axis of approximately 25-65 degrees off the longitudinal axis, the concave portion can have a varying depth with a maximum depth of 0.5-10 mm and the depression length can be 1-5 cm. These sizes may be made smaller or larger depending on the age of the intended user.

As described above and shown in FIGS. 1-4, Line X shows the longitudinal axis of the grip 1. Through hole 52, as shown in FIGS. 1-6, traverses the full length of the longitudinal axis X. The through hole 52 can be, e.g., cylindrically-round, cylindrically hexagonal, cylindrically octagonal or any other shaped for accommodating a handle of a hand-held tool.

Figure 10:
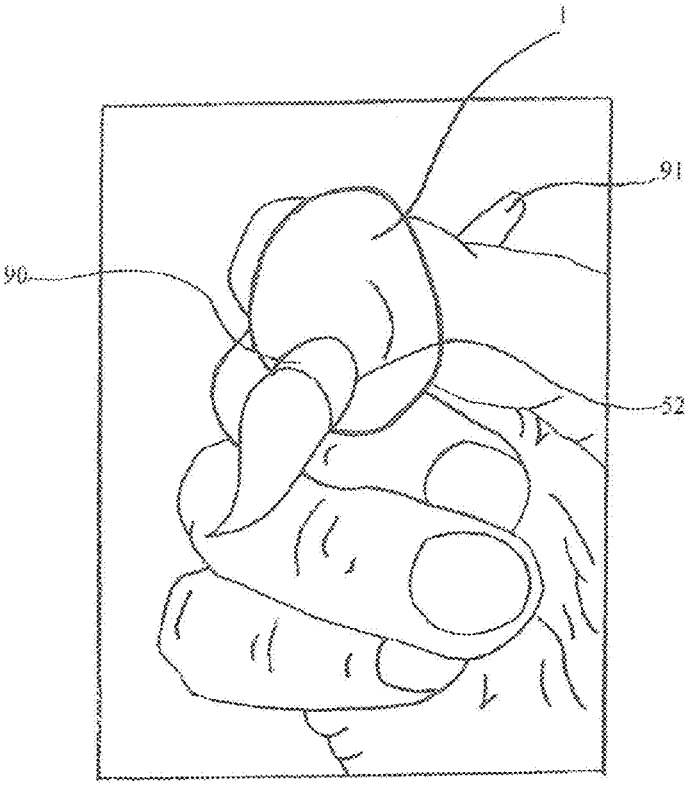
FIG. 10 shows a perspective view of a grip incorporated into a paintbrush according to the disclosed technology.
Figure 11:
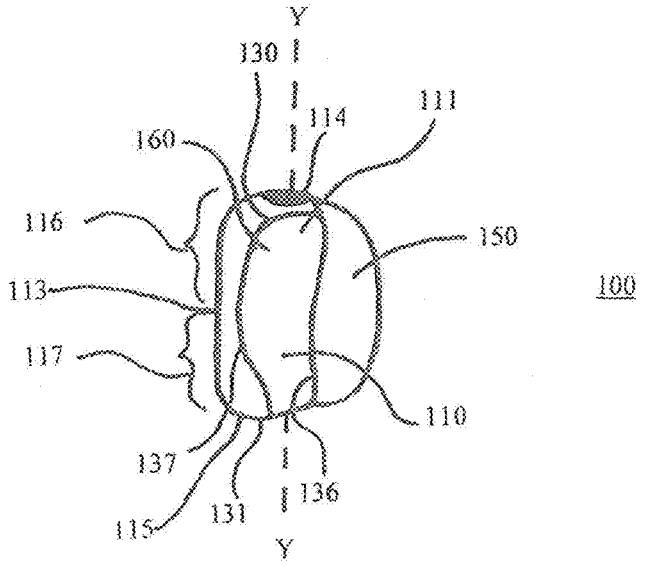
FIGS. 11-16 show perspective views of a grip of the disclosed technology having a fin.
Figure 12:
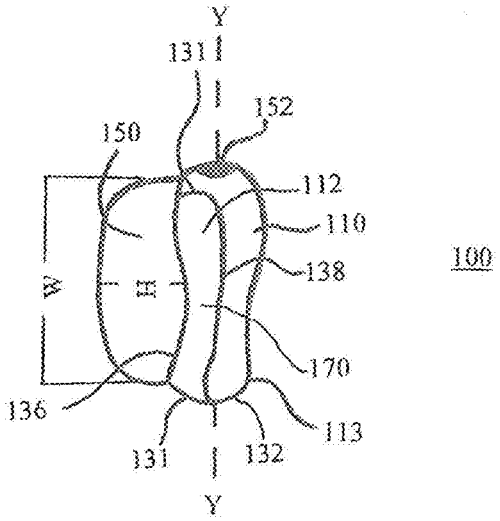
Figure 13:
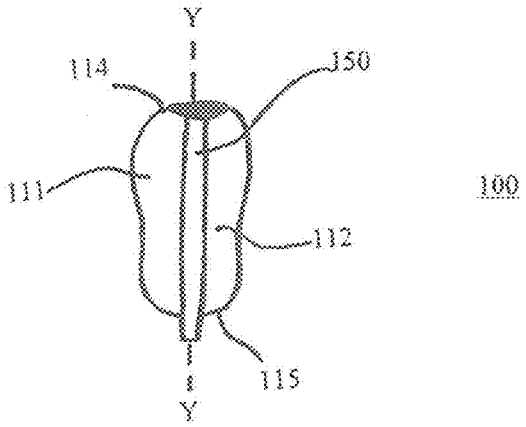
Figure 14:
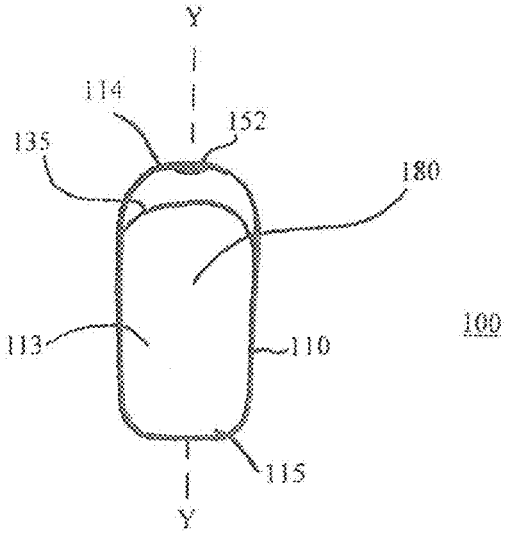
Figure 15:
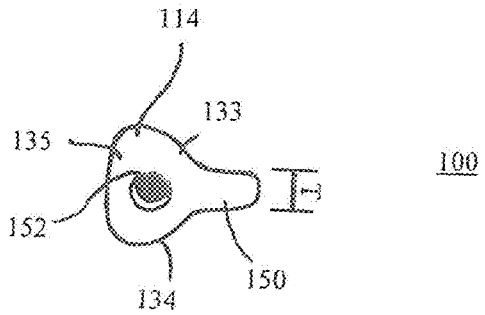
Figure 16:
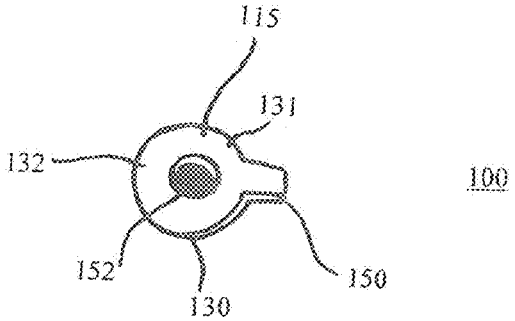

As shown in FIGS. 7-9, the grip 1 can be used conjunction with a writing instrument 60. The writing instrument 60 is inserted into the through hole 52 located along the center axis of the grip 10. In use, a person's hand 65 holds the writing grip 1 with the user's index finger 70, thumb 72 and middle finger 74. That is, a distal end of an index finger is inserted into pocket 48 and a distal end of a thumb of a user is inserted into pocket 28 with the front vertical edge 36 separating the finger tips from one another. The user can make a simple pinching motion between the finger tips which allows the user to have a proper pinch grasp. Additionally, the middle finger can be placed on the rear side in depression 50 for further support. The user's other fingers 76, 78 do not make contact with the writing grip 1.

in another implementation, as shown in FIG. 10, the grip 1 can be mounted onto an elongated handle 90 of a hand-held tool 91, e.g., a paintbrush. The grip 1 can be inserted onto the elongated handle 90 of the tool 91 using through hole 52 or the grip 1 can be permanently integrated with the elongated handle 90 as a single unit with the grip 1 and the handle 90 being manufactured from the same or different materials.

The grip 1 described in the figures is concentrated on a right-handed user. The ledges and depressions of the grips can be reversed and used for a left-handed user as well. It is also worthy to note that the grips may come in larger and smaller sizes depending on the age of the intended user.

In another implementation, as shown in FIGS. 11-16, a grip 100 can include a main body 110 having a longitudinal axis located along a centerline (Y) of the body 110. The body 110 includes three sides 111, 112, 113 forming a substantially three dimensional triangular shape, a top 114 and a bottom 115. The upper portion 116 of the grip 100 can be substantially triangular and as the grip 100 extends from the top 114 to the bottom 115, the grip 100 can become less triangular and more spherical. Even though the lower portion 117 of the grip 100 is somewhat spherical, the grip 100 for purposes of this disclosure will be referred to as having three sides 111, 112, 113 which match up with the three sides 111, 112, 113 of the upper portion 116. In some implementations, the lower portion 117 of the body 110 can be larger than the upper portion 116 of the body 110.

The grip has nine edges 130-138. Three edges 130-132 connect the bottom 115 to the three sides 111-113 (right bottom edge 130, left bottom edge 131 and rear bottom edge 132), three edges 133-135 connect the top 114 to the sides 111-113 (right top edge 133, left top edge 134 and rear top edge 135) and three edges 136-138 connect the three sides 111-113 to one another (front vertical edge 136, right vertical edge 137 and left vertical edge 138). Front vertical edge 136 has a fin 150 extending outwards from the front vertical edge 136. The fin can have a height (H) of 5-15 mm, a width (W) of 30-50 mm that can extend from the top 114 of the grip 100 along the front vertical edge 137 to the bottom 115. The fin can also have a thickness (T) of 1-5 mm. The fin 150 is used to prevent a user's thumb and index finger from physically touching each other.

A first depression 160 can be formed on the first side 111 of the grip 100. The depression 160 can be elongated and concave to allow for placement of a part of a user's thumb. The depression 160 has an axis of approximately 10-35 degrees off the longitudinal axis, the concave portion can have a varying depth with a maximum depth of 0.5-5 mm and the depression length can be 1-5 cm. These sizes may be made smaller or larger depending on the hand size of the intended user.

A second depression 170 can be formed on the third side 112 of the grip 100. The depression 170 has an axis of approximately 10-35 degrees off the longitudinal axis, the concave portion can have a varying depth with a maximum depth of 0.5-5 mm and the depression length can be 1-5 cm.

A third depression 180 can be formed on the third side 113 of the grip 100. This depression 180 receives a part of a user's middle finger. The depression 180 has an axis of approximately 25-65 degrees off the longitudinal axis, the concave portion can have a varying depth with a maximum depth of 0.5-10 mm and the depression length can be 1-5 cm.

Line Y shows the longitudinal axis of the grip 100. Through hole 152 traverses the full length of the longitudinal axis Y and is used to mount the grip 100 onto a hand-held tool as described above with regards to the pinch grip 1.

While this specification contains many specific implementation details, these should not be construed as limitations on the scope of the disclosed technology or of what can be claimed, but rather as descriptions of features specific to particular implementations of the disclosed technology. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features can be described above as acting in certain combinations and even initially claimed as such, one or more features from a claimed combination can in some cases be excised from the combination, and the claimed combination can be directed to a sub-combination or variation of a sub-combination.

The foregoing Detailed Description is to be understood as being in every respect illustrative, but not restrictive, and the scope of the disclosed technology disclosed herein is not to be determined from the Detailed Description, but rather from the claims as interpreted according to the full breadth permitted by the patent laws. It is to be understood that the implementations shown and described herein are only illustrative of the principles of the disclosed technology and that various modifications can be implemented without departing from the scope and spirit of the disclosed technology.

The invention claimed is:

1. A grip for a hand-held tool comprising:

a top, a bottom, a right side, a left side, a rear side, a right finger guide and a left finger guide, the right finger guide being formed on the right side, the right finger guide is partially formed from a first ledge extending from a right bottom edge of the grip between a front vertical edge and a right vertical edge, the first ledge having a rounded shape that curves upwards, the right finger guide is partially formed from a first depression, the first depression having a first depth, wherein the first depth of the first depression in combination with the rounded shape of the first ledge forms a first pocket, the first pocket being a cast of a tip of a thumb, the left finger guide being formed on the left side, the left finger guide is partially formed from a second ledge extending from a left bottom edge of the grip between the front vertical edge and a left vertical edge, the second ledge having a rounded shape that curves upwards, the left finger guide is partially formed from a second depression, the second depression having a second depth, wherein the second depth of the second depression in combination with the rounded shape of the second ledge forms a second pocket, the second pocket being a cast of a tip of an index finger, and the right finger guide and the left finger guide being adjacent to one another so as to form a pinch grasp area, wherein the grip is constructed of a soft and pliable material so that the first pocket and second pocket are capable of conforming to a shape of a thumb and an index finger of a user.

2. The grip for a hand-held tool of claim 1 wherein the pinch grasp area accommodates a distal end of an index finger and a distal end of a thumb of a user such that the tip of the thumb is opposed to the tip of the index finger in a pinch grasp.

3. The grip for a hand-held tool of claim 1 wherein the rear side includes third depression for receiving a middle finger of a user.

4. The grip for a hand-held tool of claim 1 further comprising:

a through hole that extends from the top to the bottom of the grip.

5. A grip for a hand-held tool comprising:

a top, a bottom, a right side, a left side, a rear side, a right finger guide and a left finger guide, the right finger guide being formed on the right side, the right finger guide is partially formed from a first ledge having a rounded shape and a first depression having a first depth, wherein the first depth of the first depression in combination with the rounded shape of the first ledge folios a first pocket, the first pocket being a cast of a tip of a thumb, the left finger guide being formed on the left side, the left finger guide is partially formed from a second ledge having a rounded shape and a second depression having a second depth, wherein the second depth of the second depression in combination with the rounded shape of the second ledge forms a second pocket, the second pocket being a cast of a tip of an index finger, and the first pocket and the second pocket being adjacent to one another so as to form a pinch grasp area, wherein the grip is constructed of a soft and pliable material so that the first pocket and second pocket are capable of conforming to a shape of a thumb and an index finger.

6. The grip for a hand-held tool of claim 5 wherein the pinch grasp area accommodates a distal end of an index finger and a distal end of a thumb of a user such that the tip of the thumb is opposed to the tip of the index finger in a pinch grasp.

7. A grip for a hand-held tool comprising:

a top, a bottom, a right side, a left side, a rear side, a right finger guide and a left finger guide, the right finger guide being formed on the right side, the right finger guide is partially formed from a first ledge extending from a right bottom edge of the grip between a front vertical edge and a right vertical edge, the first ledge having a rounded shape that curves upwards, the right finger guide is partially formed from a first depression, the first depression having a first depth, wherein the first depth of the first depression in combination with the rounded shape of the first ledge forms a first pocket, the first pocket being a cast of a tip of a thumb, the left finger guide being formed on the left side, the left finger guide is partially formed from a second ledge extending from a left bottom edge of the grip between the front vertical edge and a left vertical edge, the second ledge having a rounded shape that curves upwards, the left finger guide is partially formed from a second depression, the second depression having a second depth, wherein the second depth of the second depression in combination with the rounded shape of the second ledge forms a second pocket, the second pocket being a cast of a tip of an index finger, wherein a shape of the right finger guide is different from a shape of the left finger guide so that the shape of the right finger guide can conform to a shape of a thumb and the shape of the left finger guide can conform to a shape of an index finger, or vice versa.

* * * * *